US008281439B2

(12) United States Patent
Yusuf et al.

(10) Patent No.: US 8,281,439 B2
(45) Date of Patent: Oct. 9, 2012

(54) CONTROL AND WASH CYCLE FOR ACTIVATION AND DEACTIVATION OF CHEMISTRY IN THE WASH BATH OF AN AUTOMATIC WASHER

(75) Inventors: Zaki Yusuf, Stevensville, MI (US); Joel Adam Luckman, Benton Harbor, MI (US); Tremitchell Wright, Elkhart, IN (US); Janice M. Kaeding, Lawrence, MI (US); Timothy Nicholas Aykroyd, Brookline, MA (US); Michael Stephen Hendrickson, Saint Joseph, MI (US); Colleen M. Doyle, Stevensville, MI (US); Robert D. Riehle, Raleigh, NC (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/245,945

(22) Filed: Sep. 27, 2011

(65) Prior Publication Data

US 2012/0011662 A1 Jan. 19, 2012

Related U.S. Application Data

(62) Division of application No. 11/745,135, filed on May 7, 2007, now Pat. No. 8,047,024.

(51) Int. Cl.
*D06F 33/00* (2006.01)
*D06F 35/00* (2006.01)

(52) U.S. Cl. ..... 8/159

(58) Field of Classification Search ..... 8/158–159; 68/12.01, 12.12, 12.18, 12.23
See application file for complete search history.

(56) References Cited

U.S. PATENT DOCUMENTS

| | | | | |
|---|---|---|---|---|
| 6,502,265 | B2 * | 1/2003 | Blair et al. | 8/159 |
| 6,671,916 | B2 * | 1/2004 | Herr et al. | 8/159 |
| 2001/0042275 | A1 * | 11/2001 | Estes et al. | 8/142 |
| 2003/0154560 | A1 * | 8/2003 | Behrens et al. | 8/159 |
| 2004/0107510 | A1 * | 6/2004 | Buckroyd et al. | 8/159 |
| 2004/0134238 | A1 * | 7/2004 | Buckroyd et al. | 68/12.23 |
| 2005/0022314 | A1 * | 2/2005 | Ambuter et al. | 8/158 |
| 2007/0056119 | A1 * | 3/2007 | Gardner et al. | 8/115.51 |

* cited by examiner

*Primary Examiner* — Joseph L Perrin
(74) *Attorney, Agent, or Firm* — Clifton G. Green; Greer, Burns & Crain Ltd.

(57) ABSTRACT

A control for an automatic washer to operate the washer through a wash cycle determined based upon various soils and stains in the substrate load to be washed with a wash liquor in a wash zone of the washer. The control has a plurality of stain/soil type entrées, which can be at least one of selected and detected, and cleaned with a particular wash cycle. The control has dispensing control over at least one wash liquor additive. The control has operational control over activators and deactivators for members of the additives group. The control has operational control over the particular wash cycles using the dispensing control to dispense additives to the wash liquor at selected times during the wash cycle and operating the activators and deactivators at selected times during the wash cycle.

15 Claims, 1 Drawing Sheet

CONTROL AND WASH CYCLE FOR ACTIVATION AND DEACTIVATION OF CHEMISTRY IN THE WASH BATH OF AN AUTOMATIC WASHER

BACKGROUND OF THE INVENTION

This application is a divisional application of U.S. application Ser. No. 11/745,135 filed May 7, 2007, incorporated by reference herein in its entirety.

The present invention relates to washer controls, wash cycles and automatic washers.

In appliances that are used to treat various substrates, such as laundry appliances that treat fabrics and dishwashers that treat dishware, oftentimes different chemistries are added to the appliance during different treatment cycles or at different times during a given treatment cycle, depending on the treatment function to be performed, and depending on the item being treated, for example. It is known to provide activators in a washing cycle, such as the oxidizing agent catalysts described in U.S. Pat. No. 6,513,180.

What is needed in the art is a control for washers that can operate a washer through a variety of different wash cycles to remove a variety of different stains and soils, and to dispense appropriate wash liquor additives, and activate or deactivate those additives, as needed. It would be an improvement in the art if there were provided a control for a washer which operates the washer through wash cycles in which various wash liquor additives are activated and deactivated to remove particular soils and stains.

SUMMARY OF THE INVENTION

A control is provided for an automatic washer to operate the washer through a wash cycle determined based upon a range of conditions of the fabric load to be washed with a wash liquor in a wash zone of the washer. In an embodiment of the invention, the control includes a plurality of stain/soil type entrées, which can be at least selected or detected, and then cleaned with a particular wash cycle. The stain/soil type entrées may include grass, blood, coffee, tea, red wine, fruit juices, tomato-based, cocoa, carbon, perspiration, dirt, mud, pigments, colors, foods and oily stains and soils.

The control has dispensing control over various wash liquor additives including detergents, chlorine bleaches, color safe bleaches, cleaning boosters, oxidizing agents, pre-wash stain removers, pre-wash chemistries, switchable or tunable surfactants, wrinkle guard, color finishes, water repellency, stain guard, functional finishes, fabric softeners, water softeners, fragrances, anti-static agents, drying aids, de-wrinkling chemistries, deodorizers, surfactants, emulsifiers, enzyme activated stain removers, sudsing agents, builders, anti-redeposition polymers, in-wash stain removers and perfumes.

The control has operational control over activators and deactivators for various of the additives. The activators and deactivators include thermal, biological, chemical, electromagnetic and mechanical actions. The biological activators and deactivators may include enzymes, plant extracts, lipase, amylase, protease and microbes. The chemical activators and deactivators may include pH control, precious/noble metals, ionization, switchable surfactants, catalytic agents, and ozone. The electromagnetic activators and deactivators may include UV, microwave, electromagnetic radiation, electrolysis, visible light, and magnetic fields. The mechanical action activators and deactivators may include tumbling, impelling, nutating, agitating, flexing of the fabric load, sonic, acoustics, megasonics and ultrasound.

Ultrasonic activation should be performed at low pH from 0.1-8.5, preferably from 0.1-6.5 and more preferably from 0.1-4.0. The system should be able to monitor and control pH within these ranges. The switchable surfactant can be used to remove soil, create foam or remove foam which can reduce or increase mechanical action or provide or reduce drag in a spinning system. The surfactant can switch through pH, electrolytic water or temperature. They can also be used in recovery to turn off or release soil from the wash liquor. When the soils are released they can be filtered and drained from the system and the surfactant could be reused. Enzymatic activation can be done at temperatures from 5-25 C, or 25-50 C or 50-100 C or 100+C. The temperature range is specific to the type of enzyme being used as well as the stain being removed.

The control has operational control over the particular wash cycles using the dispensing control to dispense additives to the wash liquor at selected times during the wash cycle and operating the activators and deactivators at selected times during the wash cycle. The activators and deactivators may be operated during a portion of the wash cycle such as soak, pre-wash, standard wash, pre-rinse, rinse, fluid recovery and pre-drain.

DETAILED DESCRIPTION OF THE PREFERRED EMBODIMENTS

Figure 1:
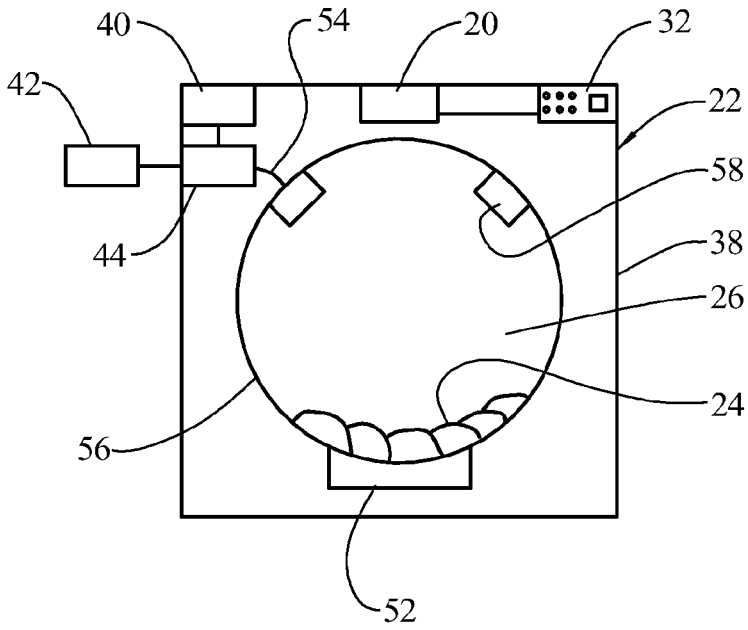
FIG. 1 is a schematic illustration of an automatic washer.
Figure 2:
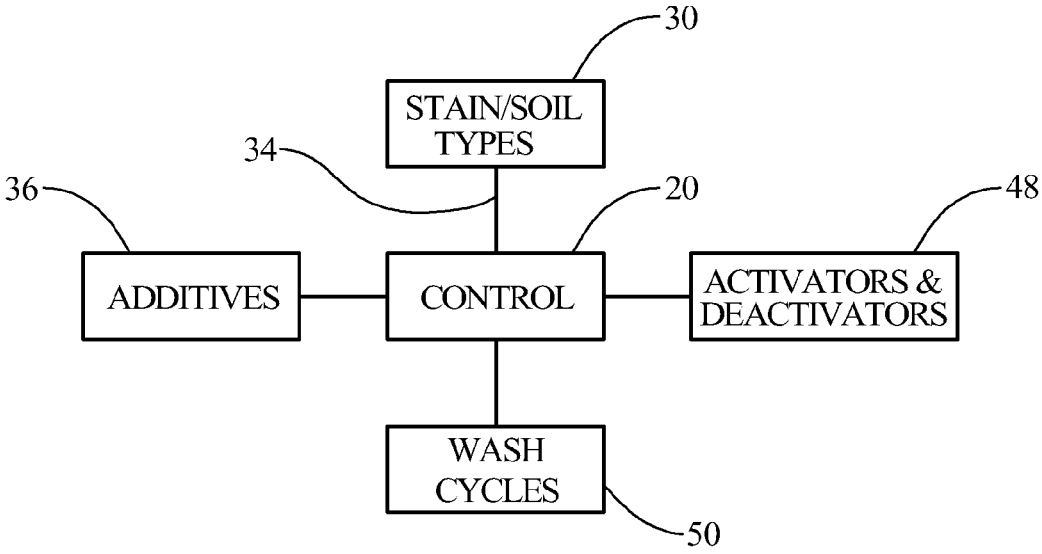
FIG. 2 is a schematic illustration of a control for an automatic washer.

In an embodiment of the invention, as shown in FIGS. 1 and 2, the present invention provides a control 20 for an automatic washer appliance 22 to operate the washer through a wash cycle determined based various soils or stains in the materials or substrates 24 to be cleaned. The washer 22 can be used to clean fabrics, such as a clothes washer or clothes refresher, could be used to clean dishware, such as a dishwasher, or could be used to clean other substrates.

In the case of a clothes washer 22, which particular embodiment will be described herein, even though the invention is not limited to such an environment, the fabric load 24 is arranged to be washed with a wash liquor after the fabric load has been introduced to a wash zone 26 of the washer. The wash liquor generally is a fluid, and may be a liquid, a gas, a vapor, a foam, or some combination of these states and may be an aqueous or non-aqueous solution or mixture.

The control 20 includes a plurality of stain/soil type entrées 30, which can be at least selected or detected, and then used to clean the fabric load with a particular wash cycle. For example, the control 20 may include a user interface 32 where a user can enter or select the type of soil or stain that is present in the fabric load 24, from a list of stain/soil entrées, or by entering information to identify a type of stain or soil. The user interface 32 could include switches or buttons dedicated to particular stains or soils, or there could be an electronic display with a drop down menu listing a variety of stain/soil entrées. A keypad may be provided to allow a user to type in or otherwise choose a particular stain or soil, and the control may then use that information to look up information about that particular stain or soil, from an internal database or memory store, whether that memory is part of software, firmware or is hard wired, or from an external database or memory store, including accessing a remote database or memory store on a local area network, a wide area network or a world wide network, such as the internet.

Also, the control 20 could include an electronic input for receiving a signal on line 34 indicative of at least one of the stain type entrées. In this way, the stain types could be selected based upon a detection of the stains present prior to or during the wash cycle, such as by a reflectivity or emissivity reading of the fabric load, or a sensing of the presence of particular stain attributes during the wash cycle, such as the presence of proteins being released into the wash liquor.

The stain/soil type entrées may include grass, blood, coffee, tea, red wine, fruit juices, cocoa, tomato-based, carbon, perspiration, pigments, colors, foods, dirt, mud and oily stains or soils.

The control 20 has dispensing control over various wash liquor additives 36 including detergents, chlorine bleaches, color safe bleaches, cleaning boosters, oxidizing agents, pre-wash stain removers, pre-wash chemistries, switchable or tunable surfactants, wrinkle guard, color finishes, water repellency, stain guard, functional finishes, fabric softeners, water softeners, fragrances, anti-static agents, drying aids, de-wrinkling chemistries, deodorizers, surfactants, emulsifiers, enzyme activated stain removers, sudsing agents, builders, anti-redeposition polymers, in-wash stain removers and perfumes.

The oxidizing agents which may be used as additives include active oxygen releasing compounds, e.g., peroxides (peroxygen compounds) such as perborate, percarbonates, perphosphates, persilicates, persulfates, their sodium, ammonium, potassium and lithium analogs, calcium peroxide, zinc peroxide, sodium peroxide, carbamide peroxide, hydrogen peroxide, and the like. These agents also include peroxy acids and organic peroxides and various mixtures thereof.

A peroxy acid is an acid in which an acidic —OH group has been replaced by an —OOH group. They are formed chiefly by elements in groups 14, 15 and 16 of the periodic table, but boron and certain transition elements are also known to form peroxy acids. Sulfur and phosphorus form the largest range of peroxy acids, including some condensed forms such as peroxydiphosphoric acid, $H_4P_2O_8$ and peroxydisulfuric acid, $H_2S_2O_8$. This term also includes compounds such as peroxycarboxylic acids and meta-chloroperoxybenzoic acid (mCPBA).

Organic peroxides are organic compounds containing the peroxide functional group (ROOR'). If the R' is hydrogen, the compound is called an organic hydroperoxide. Peresters have general structure RC(O)OOR. The O—O bond easily breaks and forms free radicals of the form RO—. This makes organic peroxides useful for cleaning purposes.

There are four possible descriptions of the oxidizing agent product composition based on concentration. "Ultra concentrated" means that 80 to 100% of the bleach is active. "Concentrated" means that 40 to 79% of the bleach is active. "Bleach with additive" means that 20-40% of the bleach is active. "Cleaning product with bleach" means that less than 25% of the bleach is active.

Oxidizing agents may be combined within a mixture that has a selection of other additive material, such as one or more of the following: builders, surfactants, enzymes, bleach activators, bleach catalysts, bleach boosters, alkalinity sources, antibacterial agents, colorants, perfumes, pro-perfumes, finishing aids, lime soap dispersants, composition malodor control agents, odor neutralizers, polymeric dye transfer inhibiting agents, crystal growth inhibitors, photobleaches, heavy metal ion sequestrants, anti-tarnishing agents, anti-microbial agents, anti-oxidants, linkers, anti-redeposition agents, electrolytes, pH modifiers, thickeners, abrasives, divalent or trivalent ions, metal ion salts, enzyme stabilizers, corrosion inhibitors, diamines or polyamines and/or their alkoxylates, suds stabilizing polymers, solvents, process aids, fabric softening agents, optical brighteners, hydrotropes, suds or foam suppressors, suds or foam boosters, fabric softeners, antistatic agents, dye fixatives, dye abrasion inhibitors, anti-crocking agents, wrinkle reduction agents, wrinkle resistance agents, soil release polymers, soil repellency agents, sunscreen agents, anti-fade agents, water soluble polymers, water swellable polymers and mixtures thereof.

A particular oxidizing agent to be added to form the oxidizing agent wash liquor could comprise a combination of water with one or more of sodium carbonate, sodium percarbonate, surfactants and enzymes.

These wash liquor additives 36 may be stored internal or external to a cabinet 38 of the washer, such as in an internal container 40 or an external container 42, or may be generated at or near the washer at the time they are needed for a particular wash cycle. Precursor chemicals may be stored at the washer, to be combined or acted upon at the time of need for a particular additive, so that unstable additives can be utilized by being generated just prior to their use. Oxidizing agents, such as hydrogen peroxide could be generated by electrolysis at a time of need, as could ozone and other additives. The additives 36 may be in the form of solids, liquids, gases, gels, foams and vapors, as well as in the form of electromagnetic radiation, such as UV. A mixing chamber 44 could also be provided wherein one or more of the additives or chemistries could be introduced to a portion of the wash liquor, and diluted therein, before being introduced to the fabric load 24.

The control 20 has operational control over activators and deactivators 48 for various of the additives. The activators and deactivators 48 may include thermal, biological, chemical, electromagnetic and mechanical actions. The biological activators and deactivators may include the use of enzymes, plant extracts, lipase, amylase, protease and microbes. The chemical activators and deactivators may include the use of pH control, precious/noble metals, ionization, switchable surfactants, catalytic agents, anti-suds materials, and ozone. The electromagnetic activators and deactivators may include the use of UV, microwaves, electromagnetic radiation, electrolysis, visible light, electric shock and magnetic fields. The mechanical action activators and deactivators may include the use of tumbling, impelling, nutating, agitating, flexing of the fabric load, sonic, acoustics, megasonics, cradle, spinning and ultrasound.

The mixing chamber 44 could be the location for activating and deactivating the various additives. For example, some oxidizing agents can be activated by elevating the temperature of the oxidizing agent above a certain threshold temperature, and the oxidizing agent will remain activated so long as it stays above a quench temperature that is lower than the threshold temperature. Therefore, the smaller mass of the oxidizing agent could be heated to the higher threshold temperature for activation, and then when it is added to the larger mass of the wash liquor, it could remain in an activated state, so long as the combined temperature of the oxidizing agent and wash liquor is above the quench temperature. This will permit less energy to be used for activation than heating the entire wash liquor mass to the activation threshold temperature.

The deactuators 48 may include removing or rendering ineffective an actuator or the result of an activator. For example, if metal ions are used to catalyze an activation of an oxidizing agent, the metal ions may be captured or removed from the wash liquor prior to the wash liquor being disposed.

The control 20 has operational control over the particular wash cycles 50 using the dispensing control to dispense additives 36 to the wash liquor at selected times during the wash cycle and operating the activators and deactivators 48 at selected times during the wash cycle 50. The activators and deactivators 48 may be operated during different portions of the wash cycle 50 such as soak, pre-wash, standard wash, pre-rinse, rinse, fluid recovery and pre-drain.

A prewash step could be provided in which essentially no detergent is added to the wash liquor, however, other additives are provided, such as activated oxidizers, ozone, enzymes or water conditioning. Water conditioning agents can be used to remove hardness, change the pH, ORP or conductivity of the wash liquor.

The activation and deactivation 48 may be carried out in a single stage, a dual stage or in multiple stages. Several methods could be used in combination or in parallel to activate. For example, an oxidizing agent, such as hydrogen peroxide could be added, activating the hydrogen peroxide with a temperature increase, adding a catalyst, further temperature adjustment and then adding ozone.

When utilizing switchable solvents, depending on the goal of the process step, particularly cycle transitions (such as amount of suds, efficiency, extraction and soluability), the solvent could be controlled, for example by pH, light, acoustics or the introduction of gases.

As examples, during the wash step, a goal could be the prevention of suds lock which can be achieved by increasing surface tension. During the extraction step, a goal could be improving extraction efficiency which can be achieved by decreasing surface tension. During a rinse step, a goal could be a clean rinse with no suds which can be achieved by increasing surface tension. Also, during the rinse step the pH could be neutralized.

In some situations, the desired effect would be the curing of the additive onto the fabric or other substrate itself, such as is done with wrinkle guard or stain guard, color finishes, water repellency, functional finishes. This could be accomplished through nano-curing. With these finishes, extreme conditions such as very high temperature or very high pH are required. However, an activation method (such as UV or pH) could be used to overcome these conditions.

The additives 36 could be stored or introduced to the wash liquor in a variety of locations including a sump 52, the storage/holding container 42 or a line 54 from a dispenser 44 to a drum 56 defining the wash zone 26.

In order to activate some additives, extreme conditions are necessary. For example, very high pHs are needed for some situations. Use of a percarbonate as an oxidizing agent results in sodium carbonate and carbonate ion which can generate a pH in the rage of about 12, depending on the temperature and concentration of the solutes in solution. To achieve a stronger bleaching agent, sodium diborate ($Na4B2O5$) can generate a pH as high as about 12.5 (that is, more hydroxyl ion concentration) depending on the temperature and concentration of sodium diborate in solution. This pH range is higher than pH generated by carbonate ion. A solution can be prepared with a combination of sodium diborate and hydrogen peroxide, with activation by one or more lasers 58 operating in the 320 to 390 nm wavelength range.

Various features of the control 20 and washer 22 have been described which may be incorporated singly or in various combinations into a desired system, even though only certain combinations are described herein. The described combinations should not be viewed in a limiting way, but only as illustrative examples of particular possible combinations of features. As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A method of washing a substrate load in a wash cycle of a washing machine operated by a control comprising the steps:

accepting the substrate load into the washing machine-for cleaning, the control monitoring a signal indicative of one of detected stain/soils from a stain/soil sensor and monitoring a signal indicating a user input of at least one of a plurality of stain/soil type entrées, the stains/soil types represented by the entrées being able to be cleaned with a particular wash cycle, selecting a wash cycle based on at least one of the signals indicating the stain/soil in the substrate load, contacting the substrate load with a wash liquor, dispensing a wash liquor additive into the wash liquor, from the group consisting of detergents, chlorine bleaches, color safe bleaches, cleaning boosters, oxidizing agents, pre-wash stain removers, pre-wash chemistries, switchable or tunable surfactants, wrinkle guard, color finishes, water repellency, stain guard, functional finishes, fabric softeners, water softeners, fragrances, anti-static agents, drying aids, de-wrinkling chemistries, deodorizers, surfactants, emulsifiers, enzyme activated stain removers, sudsing agents, builders, anti-redeposition polymers, in-wash stain removers and perfumes, and selectively activating or deactivating the dispensed additive with activators or deactivators, respectively, the activators and deactivators being from the group consisting of thermal, biological, chemical, electromagnetic and mechanical actions.

2. The method according to claim 1, wherein the stain/soil type entrées are selected from the group consisting of grass, blood, coffee, tea, red wine, tomato-based, fruit juices, cocoa, carbon, perspiration, dirt, pigments, colors, foods, mud and oily stains and soils.

3. The method according to claim 1, wherein the biological activators and deactivators are selected from the group consisting of enzymes, microbes, plant extracts, lipase, amylase and protease.

4. The method according to claim 1, wherein the chemical activators and deactivators are selected from the group consisting of pH control, precious/noble metals, ionization, switchable surfactants, catalytic agents, hydrogen peroxide, and ozone.

5. The method according to claim 1, wherein the electromagnetic activators and deactivators are selected from the group consisting of UV, microwave, electromagnetic radiation, electrolysis, visible light, laser light and magnetic field.

6. The method according to claim 1, wherein the mechanical action activators and deactivators are selected from the group consisting of tumbling, impelling, nutating, agitating, flexing of the fabric load, sonic, megasonics cradle, spin, acoustics and ultrasound.

7. The method according to claim 1, wherein the activators and deactivators are operated during a portion of the wash cycle selected from the group consisting of soak, pre-wash, standard wash, pre-rinse, rinse, fluid recovery and pre-drain.

8. A method of washing a substrate load in an automatic washer via a control for the automatic washer through a wash cycle determined based upon various soils and stains in the substrate load to be washed with a wash liquor in a wash zone of the automatic washer, comprising the steps:

accepting the substrate load in the wash zone of the automatic washer for cleaning, the control monitoring a signal indicative of one of detected stain/soils from a stain/soil sensor and monitoring a signal indicating a user input of at least one of a plurality of stain/soil type entrées, the stains/soil types represented by the entrées being able to be cleaned with a particular wash cycle, selecting a wash cycle based on at least one of the signals indicating the stain/soil in the substrate load, directing the wash liquor against the substrate load, dispensing a wash liquor additive into the wash liquor at selected times during the wash cycle, from the group consisting of detergents, chlorine bleaches, color safe bleaches, cleaning boosters, oxidizing agents, pre-wash stain removers, pre-wash chemistries, switchable or tunable surfactants, wrinkle guard, color finishes, water repellency, stain guard, functional finishes, fabric softeners, water softeners, fragrances, anti-static agents, drying aids, de-wrinkling chemistries, deodorizers, surfactants, emulsifiers, enzyme activated stain removers, sudsing agents, builders, anti-redeposition polymers, in-wash stain removers and perfumes, and selectively activating or deactivating the dispensed additive with activators or deactivators, respectively, at selected times during the wash cycle, the activators and deactivators being from the group consisting of thermal, biological, chemical and electromagnetic.

9. The method according to claim 8, wherein the stain/soil type entrées are selected from the group consisting of grass, blood, coffee, tea, red wine, tomato-based, fruit juices, cocoa, carbon, perspiration, dirt, pigments, colors, foods, mud and oily stains and soils.

10. The method according to claim 8, wherein the additives dispensed by the control and the activators and deactivators are selected and used by the control based upon a classification of the stain/soil entrées as falling into a class selected from the group consisting of proteins, fats, semisolids, complex, particular, soil, enzyme sensitive, pH sensitive and surfactant sensitive.

11. The method according to claim 8, wherein the biological activators and deactivators are selected from the group consisting of enzymes, microbes, plant extracts, lipase, amylase and protease.

12. The method according to claim 8, wherein the chemical activators and deactivators are selected from the group consisting of pH control, precious/noble metals, ionization, switchable surfactants, catalytic agents, hydrogen peroxide, and ozone.

13. The method according to claim 8, wherein the electromagnetic activators and deactivators are selected from the group consisting of UV, microwave, electromagnetic radiation, electrolysis, visible light, laser light and magnetic field.

14. The method according to claim 8, further including mechanical action activators and deactivators, wherein the mechanical action activators and deactivators are selected from the group consisting of tumbling, impelling, nutating, agitating, flexing of the substrate load, sonic, acoustics, megasonics, cradle, spin and ultrasound.

15. The method according to claim 8, wherein the activators and deactivators are operated during a portion of the wash cycle selected from the group consisting of soak, pre-wash, standard wash, pre-rinse, rinse, fluid recovery and pre-drain.

* * * * *